US005943825A

United States Patent [19]

Procton et al.

[11] Patent Number: 5,943,825

[45] Date of Patent: Aug. 31, 1999

[54] ENTRYWAY SYSTEM AND METHOD

[75] Inventors: Jerome C. Procton, Greensboro; Brad I. Procton, High Point; Kevin T. MacDonald; Victor T. Massey, both of Greensboro, all of N.C.

[73] Assignee: Endura Products, Inc., Greensboro, N.C.

[21] Appl. No.: 09/140,278

[22] Filed: Aug. 26, 1998

[51] Int. Cl.[6] ..... E06B 1/70

[52] U.S. Cl. ..... 49/469; 49/470

[58] Field of Search ..... 49/467, 469, 470, 49/471, 504

[56] References Cited

U.S. PATENT DOCUMENTS

| | | | |
|---|---|---|---|
| 3,083,420 | 4/1963 | Tinflow . | |
| 3,521,404 | 7/1970 | Hager et al. | 49/469 X |
| 3,667,192 | 6/1972 | Sewell | 52/213 |
| 3,762,100 | 10/1973 | Kempel | 49/468 |
| 3,774,343 | 11/1973 | Cribben et al. | 49/467 |
| 3,851,420 | 12/1974 | Tibbetts | 49/471 |
| 3,854,246 | 12/1974 | McAllister | 49/470 |
| 3,885,351 | 5/1975 | Imperial et al. | 49/501 |
| 3,900,967 | 8/1975 | Bursk et al. | 49/468 |
| 3,967,412 | 7/1976 | Governale | 49/468 |
| 3,987,588 | 10/1976 | Imperial et al. | 49/501 |
| 4,185,416 | 1/1980 | Wilmes | 49/406 |
| 4,185,417 | 1/1980 | McKann | 49/470 |
| 4,193,375 | 3/1980 | Sharland et al. | 118/504 |
| 4,224,766 | 9/1980 | Procton | 49/468 |
| 4,287,684 | 9/1981 | McKann | 49/468 |
| 4,300,314 | 11/1981 | Dittrich | 49/470 |
| 4,352,258 | 10/1982 | Bursk et al. | 49/468 |
| 4,399,636 | 8/1983 | Blackwell | 49/469 |
| 4,411,104 | 10/1983 | St. Aubin | 49/470 |
| 4,447,987 | 5/1984 | Lesosky | 49/468 |
| 4,447,989 | 5/1984 | Mailand et al. | 49/488 |
| 4,449,267 | 5/1984 | Siemion | 15/257 |
| 4,514,536 | 4/1985 | Giguere | 49/470 |
| 4,538,380 | 9/1985 | Colliander | 49/475 |
| 4,565,033 | 1/1986 | Tinfow | 49/468 |
| 4,658,548 | 4/1987 | Gerritsen | 49/498 |
| 4,782,630 | 11/1988 | Kleyn | 49/505 |
| 4,807,396 | 2/1989 | Heikkinen | 49/470 |
| 4,831,779 | 5/1989 | Kehrli et al. | 49/469 X |
| 4,945,680 | 8/1990 | Giguere | 49/468 |
| 5,001,865 | 3/1991 | Procton | 49/469 |
| 5,010,690 | 4/1991 | Geoffrey | 49/468 |
| 5,022,206 | 6/1991 | Schield et al. | 52/455 |
| 5,067,279 | 11/1991 | Hagemeyer | 49/470 X |
| 5,136,814 | 8/1992 | Headrick | 49/468 |

(List continued on next page.)

OTHER PUBLICATIONS

Anderson brochure, p. 6 date unknown.
Endura flier, two pages, date unknown.
Therma Tru Flier, pp. 3–8 and 15–16, date unknown.
Therma Tru Technical Manual, selected pages, Oct. 1994.
Peachtree Technical data brochure, selected pages, 1987.
Weathershield Product Catalog, selected pages, 1996.
Peachtree Avanti Brochure, 1985.
The Garden Door, pp. 1–4, date unknown.
Cornell patent drawings for U.S. Patent 3,079,653, Mar. 5, 1963.
Drawings from co–pending application Ser. No. 08/967,529.
Acorn Steel Door Systems Brochure, date unknown.
Pemko Catalog, 1991–92.

*Primary Examiner*—Daniel P. Stodola
*Assistant Examiner*—Hugh B. Thompson

[57] ABSTRACT

A building entryway system with a high degree of modularity to accommodate active inswing doors or inactive sidelight panels is disclosed for use with conventional jambs. Specifically, an extruded aluminum sill is mated with an extruded polymeric receiving unit. The receiving unit defines a u-shaped channel which accepts a weather strip or panel cap. Either the weather strip or panel cap is slidably positioned within the channel under the door. Additionally a door sweep attached to the active doors sealingly engages the weather strip to prevent water from entering the building.

13 Claims, 6 Drawing Sheets

U.S. PATENT DOCUMENTS

| | | | |
|---|---|---|---|
| 5,168,669 | 12/1992 | Knapp | 79/482 |
| 5,179,804 | 1/1993 | Young | 49/471 |
| 5,230,181 | 7/1993 | Geoffrey et al. | 49/469 |
| 5,283,977 | 2/1994 | Smith | 49/380 |
| 5,325,648 | 7/1994 | Menard | 52/456 |
| 5,426,894 | 6/1995 | Headrick | 49/467 X |
| 5,469,665 | 11/1995 | Biebuyck | 49/470 |
| 5,517,788 | 5/1996 | McGough et al. | 49/468 |
| 5,524,391 | 6/1996 | Joffe et al. | 49/468 |

ENTRYWAY SYSTEM AND METHOD

BACKGROUND OF THE INVENTION

1. Field of the Invention

This invention pertains to a system for entryways, preferably for use in multi-door and multi-sidelight entryways.

2. Description of the Prior Art and Objectives of the Invention

An increasing desire for modular entryways for homes and other buildings has been felt in recent years. Modular entryways allow installation contractors to stock fewer parts, but still customize entryways to the desires of the builder. Interchangeable parts allow great versatility in the number of permutations of entryways creatable on the same sill. The use of synthetic materials has also helped expand the number of available options to the installer. In addition, modular entryway units need to repel elements and provide for an efficient thermal break.

While presently available entryway devices are generally suitable for most purposes, there is still a need to improve the weather resistant qualities of a modular entryway system while at the same time providing greater flexibility in creating different configurations or permutations of entryways from a minimum of standard inventory parts.

Additionally states such as North Carolina, Florida and Texas now have building codes which require very high levels of weather penetration performance. I.e., the entryway systems must be able to prevent air and/or water from entering the entryway even in hurricane or other high wind situations.

With the above concerns in mind it is an objective of the present invention to provide an entryway system and method which allows flexibility in the number of configurations possible from a minimum number of parts.

It is a further objective of the present invention to provide a double sealing entryway system for optimum weather proofing.

It is yet a further objective of the present invention to present an inswing door with an attached sweep which effectuates a strong weather proof seal.

It is still a further objective of the present invention to provide an entryway system which includes a slanted U-shaped channel that accepts a weather strip or a sidelight panel cap along its extended length.

It is another objective to provide an entryway system having a relatively low profile.

It is yet another objective to provide an entryway system allowing use of synthetics or composite materials to inhibit decay.

It is still another objective to provide an effective thermal break between the outside surface and interior surfaces of the entryway system.

It is a further objective to use current jamb or frame specifications to reduce the need to change frame inventory to accommodate the new sill.

It is yet a further objective to provide an entryway system which provides optimal sealing for all door types from single through multiple panel configurations.

These and other objectives and advantages will be realized by those skilled in the art upon closer inspection of the accompanying detailed description and drawing figures.

SUMMARY OF THE INVENTION

This invention discloses a conventional extruded aluminum sill member which includes a vertical leg and a step portion which slopes downwardly and away therefrom. A receiving unit is attached to the sill to form the threshold assembly. The receiving unit comprises a generally vertical back or rear wall which is preferably stapled to a support member. Depending slightly downwardly and away from the vertical back wall is a slanted member, which, in turn, forms one wall of the generally U-shaped channel, wherein the U-shaped channel is slightly angled from the horizontal. Extending upwardly from the opposite side wall of the U-shaped channel is a short, generally vertical member. At a right angle thereto is a sloped surface which curls to form a lip which fits against a complementary lip on the vertical leg of the sill. The support member upon which the sill rests may be wood or a composite as is conventional in the industry. Additionally, it is possible to provide an oak variation which may be more visually pleasing, or to replace the receiving unit with an entirely aluminum integrated sill and receiving unit in places where thermal breaks are not desired.

A resilient weather strip is inserted into a portion of the U-shaped channel. The weather strip comprises preferably a polyethylene covered foam which has a first generally horizontal portion, a second portion which is generally vertical and rests against the short generally vertical member of the receiving unit and a sloped, short, third portion which slants downwardly towards the back wall of the receiving unit. In use, the weatherstrip is effectively under the operating door.

Coupled with the threshold assembly is an extruded polymeric door sweep which is positioned on the bottom edge of a conventional door. The door sweep comprises a horizontal member which lies flush against the bottom surface of the door. Depending from the horizontal surface are preferably a flexible rear vertical leg, a second middle vertical leg and an elongate flexible front bulb. When the door is closed over the threshold assembly, the flexible rear leg is parallel to and in approximately the same plane as the back wall of the receiving unit; the middle vertical leg compresses the resilient weather strip and the bulb compresses over the upper lip of the receiving unit. The sweep, weatherstrip and receiving unit form a system which when used together provide a strong seal between the sill and door bottom thereby meeting or exceeding most severe weather building code requirements. An additional front flange may depend from the horizontal member outwardly and downwardly to divert rain from the door. An upwardly extending flange is attached to the bottom of the door. The middle vertical leg of the door sweep can be integrally formed with the rear vertical leg, but such is not preferred.

This system uses both bumper seals contiguous the sill body (the resilient strip) combined with flexible or rigid sealing members on the door bottom (the flanges of the sweep) to provide a multiple sealing system under the active panel. Such a system, unlike those on the face of the door or using very high rise sections of the sill, creates a high performance seal utilizing both sill and door bottom in combination. Use of one or the other part does not provide such a seal. This arrangement further has the advantage of being designed for use with conventional industry door frames. Thus, the producer will have no additional steps or inventory in the manufacture or assembly of the door frame.

For nonactive sections of the entryway system, sidelight panel caps may be fitted into the U-shaped channel and allow sidelight panels to rest thereon. It is also possible to provide sidelight panel caps which snap over the top of the receiving unit without utilizing the U-shaped channel. Additionally astragals or mullions may be used as needed to separate the inactive sections of the entryway system from the active sections or to divide two active sections.

DETAILED DESCRIPTION OF THE PREFERRED EMBODIMENTS AND OPERATION OF THE INVENTION

Figure 1:
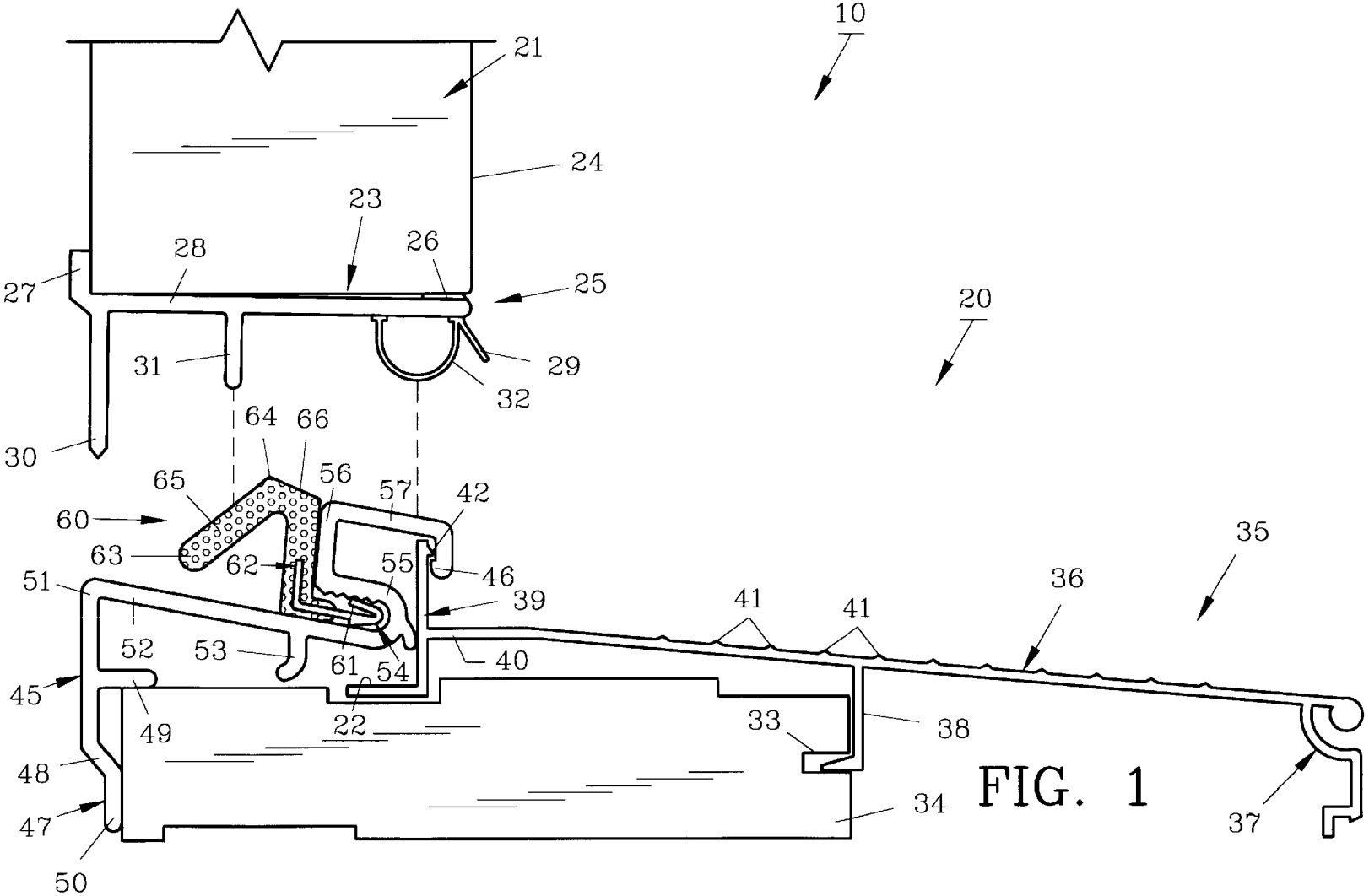
FIG. 1 shows a side elevational view of the threshold assembly of the entryway system of the present invention with the door and door sweep raised therefrom for clarity.
Figure 2:
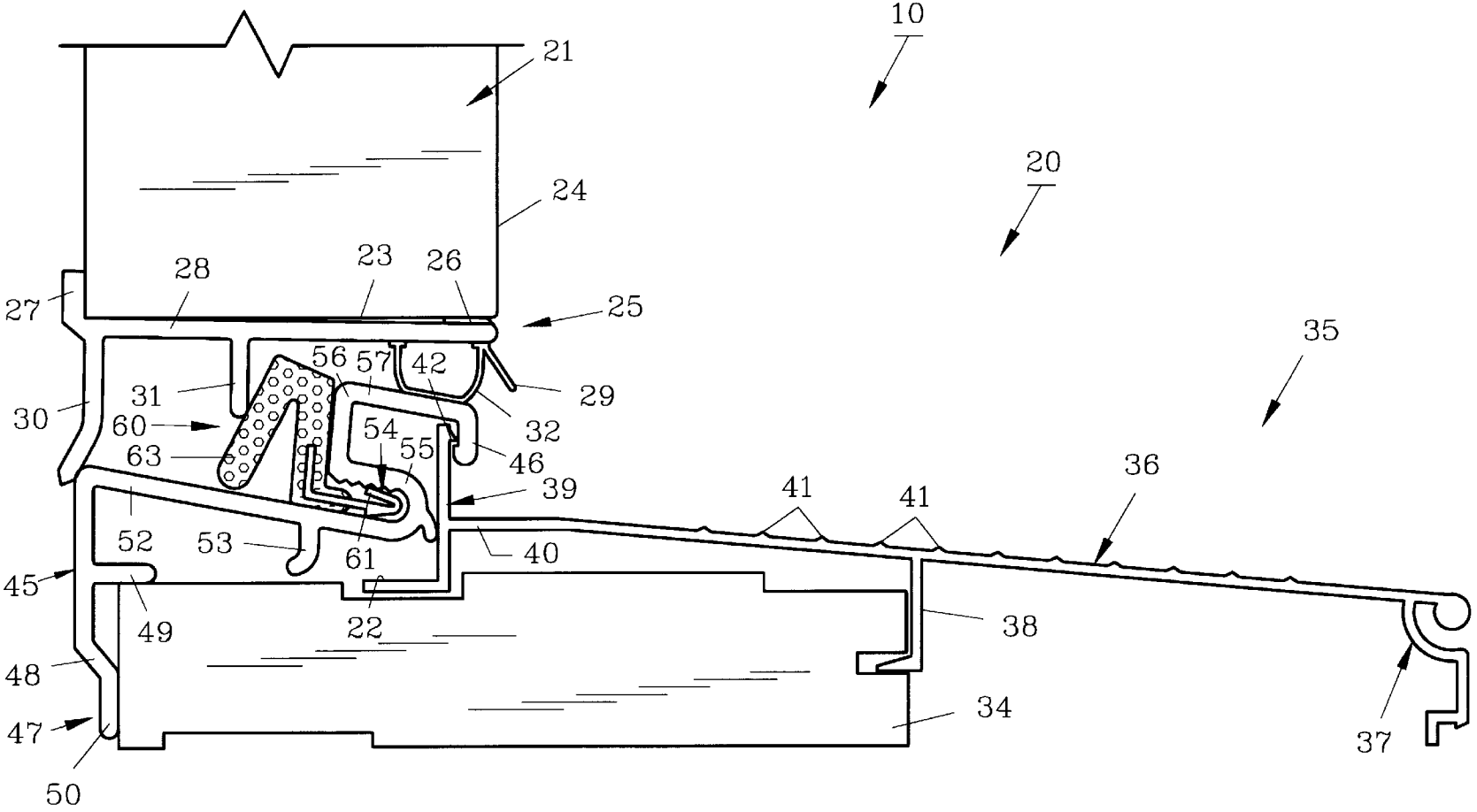
FIG. 2 depicts the threshold assembly of FIG. 1 with the door in its normal closed position.

Turning now to the drawings, FIGS. 1 and 2 show a side view of active section 20 of entryway system 10. Active section 20 is used with an active in-swing door, such as door 21 and extends the entire door width. Door 21 includes bottom surface 23 with elongated door sweep 25 flush thereagainst. Door sweep 25 includes flexible front door lip 26 and rear vertical door lip 27 which both extend upwardly from horizontal member 28 on opposite sides thereof. Lips 26 and 27 may be stapled, fastened, screwed, adhered or otherwise attached to flat bottom edge 23 of door 21. It is further possible to provide a door with sweep 25 integrally formed therewith for permanent placement, but such is not preferred. Front lip 26 is preferably slanted inwardly even when not attached and when attaches lip 26 is sandwiched between bottom surface 23 and horizontal member 28. Proximate front door lip 26 is front flange 29 which slants downwardly and away from horizontal member 28. Front flange 29 urges water away from the vertical plane formed by front surface 24 of door 21 onto top surface 36 of sill 35.

Rear leg 30, middle leg 31 and resilient front bulb 32 depend from horizontal member 28. While not preferred, middle leg 31 and rear leg 30 could be formed as a single box or other similar structure (not shown). Leg 30 and bulb 32 are preferably flexible, while leg 31 is preferably rigid; all three are preferably integrally formed with horizontal member 28. While it is preferred that bulb 32 be generally ovoid, other suitable shapes are possible. It should be understood that bulb 32 extends the length of sweep 25, but since the cross-sectional shape is bulb-like, it is described as a bulb.

Conventional elongated aluminum sill 35 rests on support member 34, which may be wood, a composite or a purely synthetic material depending on the cost concerns of the user. While a slight space is shown in the drawings between sill 35 and support member 34, this is exaggerated for clarity, and it should be understood that sill 35, specifically horizontal portion 22 of leg 39 is flushly positioned on support member 34. Sill 35 includes front leg 37 which is preferably curled as shown. Middle leg 38 is L-shaped and fits within channel 33 defined by support member 34. Vertical leg 39 is also L-shaped similarly to middle leg 38, but extends upward past the plane of top surface 36. Top surface 36 slopes downwardly and away from vertical leg 39 to front leg 37, although as shown it is within the scope of the present invention to include flat, horizontal surface section 40 contiguous to vertical leg 39. Ridges 41 may be included on top surface 36 for additional friction during use. Vertical leg 39 also includes exterior lip 42 which engages lip 46 of elongated receiving unit 45.

Receiving unit 45 in FIGS. 1 and 2 comprises rear wall 47 which is generally vertically oriented, although bend 48 gives rear wall 47 a slightly s-shaped configuration. Horizontal leg 49 and lower portion 50 of rear wall 47 are contiguous support member 34 and may be connected thereto by any number of conventional fasteners such as adhesives, staples, nails, screws or the like. Staples are the preferred fastener for speed and efficiency in manufacturing or installation. Slanting downwardly from upper edge 51 of rear wall 47 is middle portion 52. Middle portion 52 is preferably planar and includes optional downwardly depending support leg 53. When excess weight is placed on receiving unit 45, leg 53 provides additional support and prevents portion 52 and wall 57 from over-flexing. Middle portion 52 defines the lower wall of U-shaped channel 54. The upper wall of U-shaped channel 54 is formed by serrated portion 55. Since middle portion 52 is slanted slightly downwardly, U-shaped channel 54 is only generally horizontal. At a right angle to serrated portion 55 and extending upwardly therefrom is generally vertical interior wall 56. Wall 56 is connected to lip 46 by upper wall 57. While it is preferred that receiving unit 45 be formed from an extruded synthetic material, it is possible to provide a multi-sectional receiving unit of wood or other natural materials to improve its visual appeal.

As further shown in FIG. 1, positioned in U-shaped channel 54 is weather strip 60 which includes flange 61 to engage serrated portion 55 to hold weather strip 60 tightly within channel 54. Generally vertical portion 62 of weather strip 60 is preferably held contiguous wall 56, but flange 61 can be selectively positioned within channel 54. Slanted portion 63 is directed downwardly and inwardly from upper edge 64 towards rear wall 47. Weather strip 60 is preferably resilient foam 65 covered by polyethylene film 66, but other similar weather strips are contemplated.

As seen in FIG. 2, middle leg 31 of door sweep 25 compresses weather strip 60 when door 21 is closed thereby forming a weather tight seal therebetween. Bulb 32 also compresses and forms a seal against upper wall 57. If water should inadvertently pass the dam formed by vertical leg 39 and these two seals, then the slope of middle portion 52 of receiving unit 45 hinders the ability of the water to run inwardly. It should also be noted that receiving unit 45 is preferably an extruded vinyl member and forms an effective thermal barrier to further insulate the house or building from outside elements. Thus, sweep 25 and weather strip 60 when used together provide a strong positive seal between door 21 and sill 35. This system approximates conventional interlocking mechanisms, but uses modern materials for long life and flexible adjustment. Specifically, this system allows the seals to be formed even if there are height irregularities across the horizontal plane of sill 35 and the subfloor (not shown). This adaptability is a desirable feature for installers.

Figure 3:
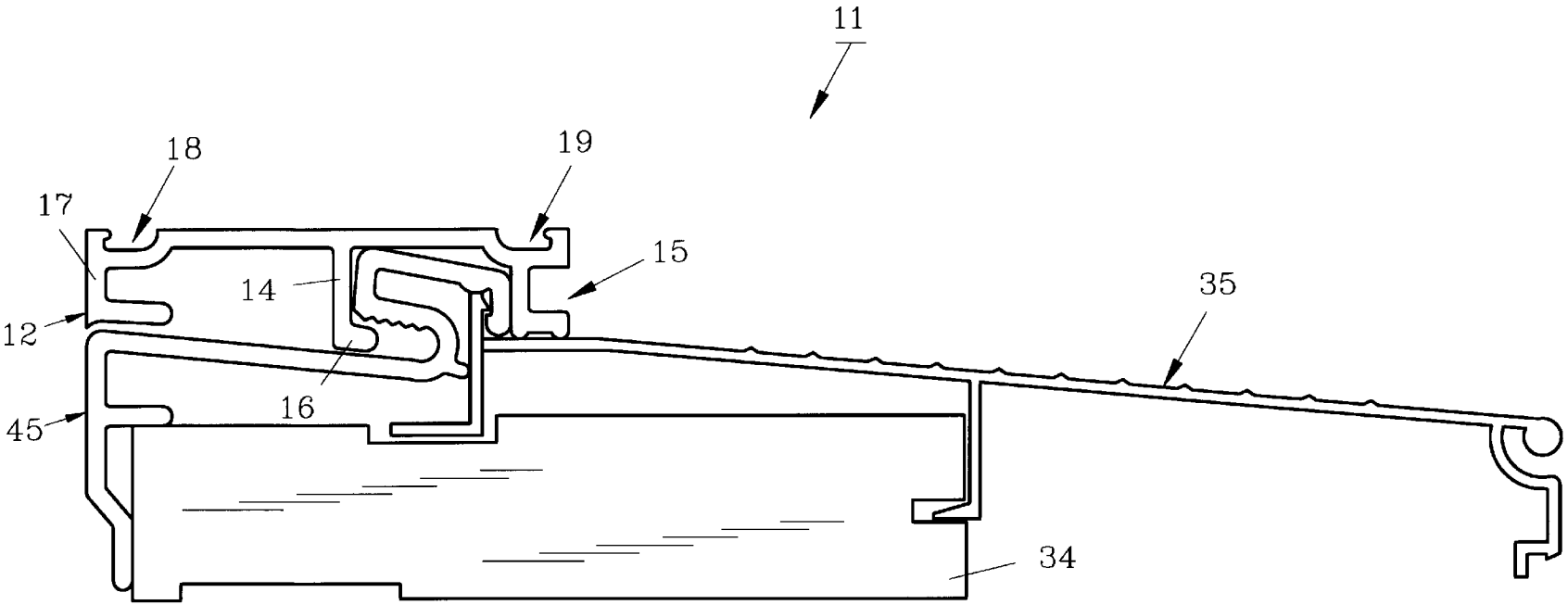
FIG. 3 illustrates a partial side elevational view of the sidelight assembly of the entryway system of the present invention.
Figure 4:
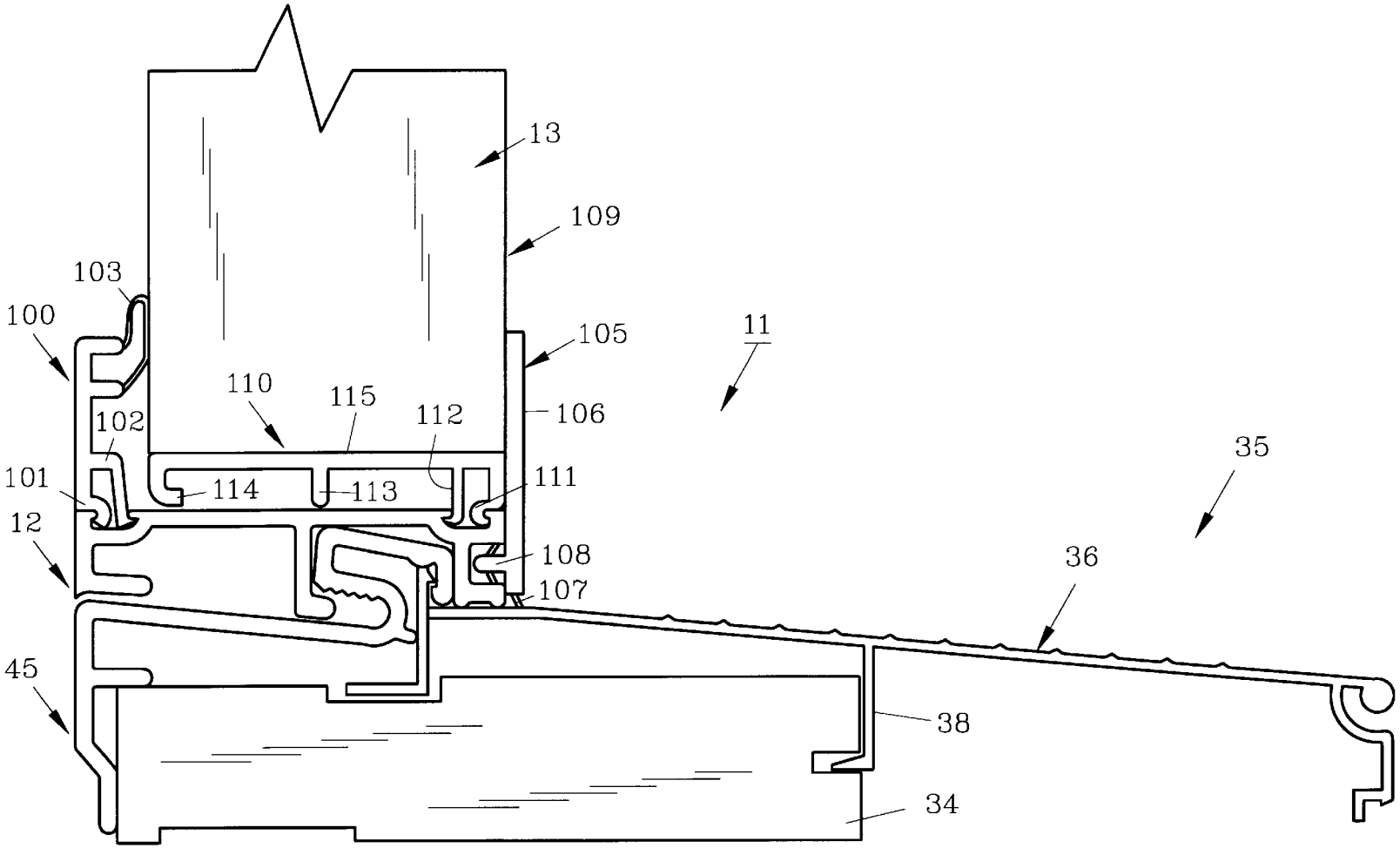
FIG. 4 demonstrates a complete side elevational view of the sidelight assembly of FIG. 3.

In contrast to active section 20 of entryway system 10, inactive section 11, as seen in FIGS. 3 and 4, replaces weather strip 60 with sidelight panel cap 12, and door 21 with sidelight panel 13 (FIG. 4). Inactive section 11 may be a sidelight such as shown, a fixed door panel, direct set glass or other such devices. Panel cap 12 snaps onto receiving unit 45 by means of depending leg 14 and front U-shaped leg 15, which snap over upper wall 57. Lip 16 on leg 14 fits partially within U-shaped channel 54. Rear leg 17 lies flush on upper edge 51. Panel cap 12 defines C-shaped channels 18 and 19 (FIG. 3) which receive sealing member 100 and sidelight base 110 respectively (FIG. 4). Sealing member 100 includes lip bearing legs 101 and 102 which pressure fits by flexing for frictional engagement within channel 18. Flexible bulb 103 forms a seal with sidelight panel 13. Base 110 supports sidelight panel 13 and includes legs 111 and 112 which pressure fit into channel 19. Legs 113 and 114 depend from horizontal portion 115 and support the same. Front guard 105 includes vertical portion 106 with outwardly and downwardly sloped flexible flange 107. Flanged arm 108 fits within U-shaped leg 15 to hold front guard 105 flush against front surface 109 of sidelight panel 13. It should be noted that sealing member 100, front guard 105 and base 110 are elongated and extend the length of inactive section 11. Additional flanges or caulk (not shown) may keep water from penetrating between cap 12 and panel 13 and/or receiving unit 45 and cap 12. This multi-piece assembly allows for easy changes in the vertical positioning of panel 13 by changing the length of legs 111–114 on base 110. Similarly, front guard 105 and sealing member 100 may be resized as needed or desired.

Figure 5:
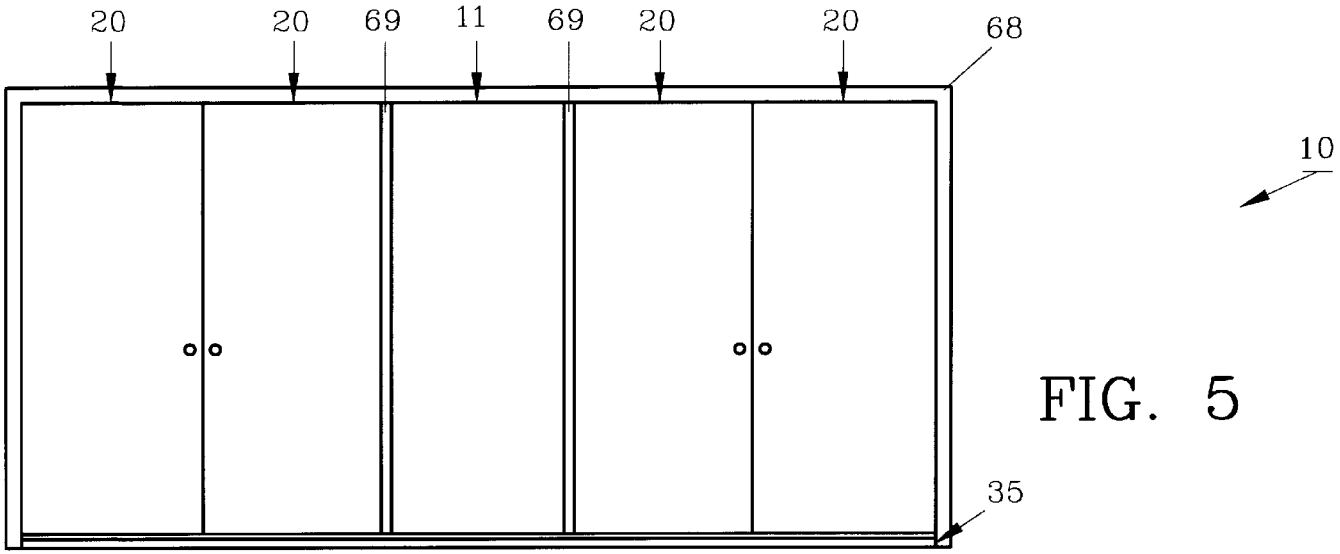
FIG. 5 features one configuration of a completed entryway system using the present invention, as seen from the front.
Figure 6:
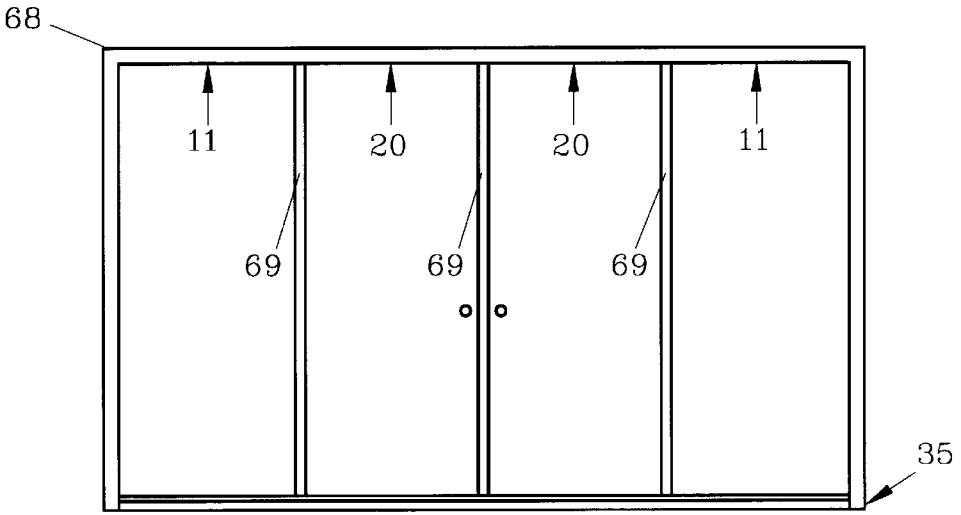
FIG. 6 pictures an alternate configuration of a completed entryway system using the present invention, as seen from the front.

It should be noted that U-shaped channel 54, sill 35 and receiving unit 45 are elongated and continuous, that weather strip 60 may be slid to a desired position with channel 54, and sidelight panel caps 12 likewise slidably positioned within channel 54 to create any number of different entryway configurations as seen in FIGS. 5 and 6. Astragals or preferably mullions 69 separate frame 68 into active sections 20 and inactive sections 11 or divide active sections 20 from each other. Specifically, active sections 20 are seen in various positions in entryway system 10 as are inactive sections 11. It should be appreciated that different lengths of entryway system 10 are possible, thus allowing the contractor to install entryway system 10 with from one to five active sections, and from zero to four inactive sections, all on entryway system 10. Likewise, entryway system 10 may be lengthened or shortened so that multiple (for two or more sections) units may be constructed from long lengths. This facilitates flexible manufacturing of multiple door units without special order or additional inventory. While any number of configurations are possible, five sections are preferred. E.g. FIG. 5 shows four active sections 20 and one inactive section 11 for a total of five sections, but FIG. 6 shows two active sections 20 and two inactive sections 11 for a total of four sections. Mullions 69 may be used between inactive sections 11 and active sections 20 or between active sections 20, or even between inactive sections 11 if desired. This modularity greatly increases the number of permutations possible with minimum stock required by the installer.

Figure 7:
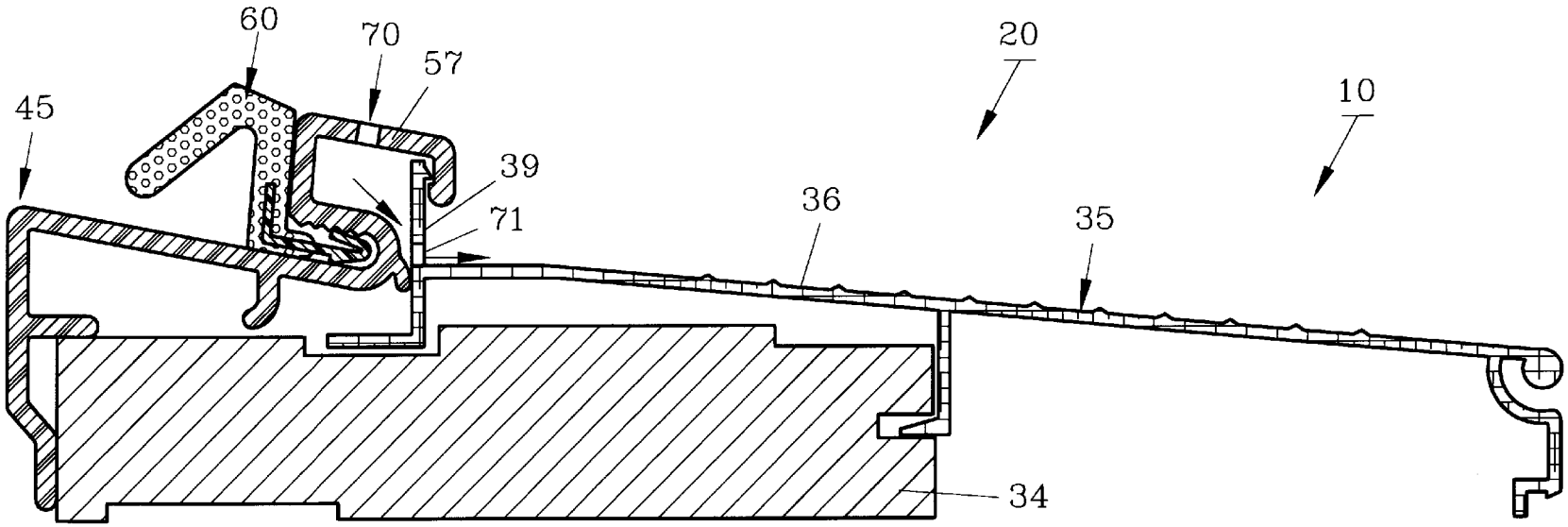
FIG. 7 shows a first optional drain configuration used in the entryway system of the present invention.

As seen in FIG. 7, entryway system 10 may be modified with optional drains in order to improve weather proofing qualities. Specifically, in FIG. 7, upper wall 57 and vertical leg 39 define apertures 70 and 71 respectively, to allow water to drain out over upper surface 36 of sill 35. Other drain configurations are possible as would be well understood, but regardless of configuration, such means to drain entryway system 10 are optional.

The preferred method of creating entryway system 10 comprises selecting a roughed out, unfinished entryway, (not shown) such as during construction of a new building. The builder or owner selects the desired number and arrangement of active doors and fixed panels. As noted above this can include preferably from one to five active doors and from zero to four fixed panels. The total number of sections is limited only by the length of the roughed, unfinished entryway or frame 68. A threshold assembly formed from a mated sill 35 and receiving unit 45 (FIG. 1) is provided. The assembler (not shown) cuts the threshold assembly to the desired length, approximately equal to the length of the roughed entryway and installs it with frame 68 as is conventional with appropriate fasteners. The assembler then divides the threshold assembly into a plurality of sections, each of a length shorter than the total length of the threshold assembly. Astragals or preferably mullions, such as mullion 69, (FIGS. 5 and 6) may be placed between these sections in frame 68 to mark the ends of the sections and separate the same. For each active section 20, a length of weatherstrip 60, of a length equal to the length of the corresponding section, is cut. This is then snapped into unshaped channel 54 and slid into place. For each inactive section 11, a length of panel cap 12, of a length equal to the length of the corresponding section, is cut. This too is then snapped into unshaped channel 54 and slid into place. Front guard 105, base 110 and sealing member 100 are then snapped into place. Mullions 69 are then fixed into place in frame 68 through conventional means and sidelight panels 13 and doors 21 are then attached. At least one door 21 is positioned over the threshold assembly and is preferably an inswing door. Door sweep 25 is positioned on bottom edge 22 of door 21 with its downwardly depending members 30–32. The threshold assembly may include the drain of FIG. 7, and it should be appreciated that providing the threshold assembly comprises providing a threshold assembly with the structure recited in the corresponding description above.

The preceding recitation is provided as an example of the preferred embodiments and is not meant to limit the nature of scope of the present invention or appended claims.

We claim:

1. An entryway system comprising:

a) a threshold assembly, said threshold assembly comprising:

i) a sill, said sill comprising a vertical leg;

ii) a receiving unit, said receiving unit contiguous said vertical leg, said receiving unit defining a U-shaped channel, the open end of said U-shaped channel facing from said vertical leg and the closed end of said U-shaped channel adjacent said vertical leg, said receiving unit having a rear wall, said rear wall opposite said vertical leg;

iii) a weather strip, said weather strip positionable along said U-shaped channel;

b) a door, said door positioned over said receiving unit; and c) a door sweep, said door sweep comprising:

i) a horizontal member, said horizontal member contacting said door;

ii) a leg, said leg depending from said horizontal member, said leg abutting the rear wall of said receiving unit; and iii) a bulbous member, said bulbous member depending from said horizontal member, said bulbous member positioned so as to provide a first seal with said receiving unit.

2. The entryway system of claim 1 further comprising a support member, said support member positioned under said sill.

3. The entryway system of claim 1 further comprising a sidelight cap, said sidelight cap selectively positioned above said receiving unit.

4. The entryway system of claim 1 wherein said receiving unit further comprises a lip, said lip proximate said vertical leg.

5. The entryway system of claim 1 wherein said door sweep further comprises a second vertical leg, said second vertical leg depending from said horizontal member.

6. The entryway system of claim 5 wherein said second vertical leg is positioned between said first vertical leg and said bulbous member.

7. The entryway system of claim 1 wherein said weather strip comprises:

a generally horizontal section;

a generally vertical section, said generally vertical section defining two ends, said generally vertical section contiguous said horizontal section at one end; and a downwardly depending section, said downwardly depending section contiguous said generally vertical section at the other of said ends, and slanting from said vertical section.

8. The entryway system of claim 1 wherein said threshold assembly defines a drain.

9. The entryway system of claim 1 wherein said door sweep further comprises a flange, said flange extending from said horizontal member.

10. The entryway system of claim 1 wherein said system accommodates a movable door and a fixed panel.

11. The entryway system of claim 1 wherein said receiving unit further comprises:

a lip, said lip proximate said vertical leg;

a wall, said wall extending generally upwardly from said U-shaped channel; and an upper wall, said upper wall connecting said lip to said wall.

12. The entryway system of claim 11 wherein said vertical leg comprises an exterior lip, said exterior lip engaging said lip of said receiving unit to form a seal therebetween.

13. The entryway system of claim 11 wherein said bulbous member compresses against said upper wall when said door is closed.

* * * * *